US008696397B2

(12) United States Patent
MacDonald

(10) Patent No.: US 8,696,397 B2
(45) Date of Patent: Apr. 15, 2014

(54) SURFBOARD

(75) Inventor: Daniel Pene MacDonald, Currumbin (AU)

(73) Assignee: DMS Composites Pty Ltd., Currumbin, Queensland (AU)

( * ) Notice: Subject to any disclaimer, the term of this patent is extended or adjusted under 35 U.S.C. 154(b) by 0 days.

(21) Appl. No.: 13/250,470

(22) Filed: Sep. 30, 2011

(65) Prior Publication Data

US 2013/0084763 A1 Apr. 4, 2013

(51) Int. Cl.
*A63C 5/03* (2006.01)

(52) U.S. Cl.
USPC ..... 441/74; 441/65; 441/68

(58) Field of Classification Search
USPC ..... 441/74, 56, 68, 65
See application file for complete search history.

(56) References Cited

U.S. PATENT DOCUMENTS

| | | | | | |
|---|---|---|---|---|---|
| 5,018,760 | A * | 5/1991 | Remondet | 280/609 |
| 5,295,883 | A * | 3/1994 | Moran | 441/65 |
| 5,489,228 | A * | 2/1996 | Richardson et al. | 441/74 |
| 5,514,017 | A * | 5/1996 | Chimiak | 441/65 |
| 5,882,776 | A * | 3/1999 | Bambara et al. | 428/215 |
| 5,944,570 | A * | 8/1999 | Appleby | 441/65 |
| 6,712,657 | B1 * | 3/2004 | Echecopar | 441/74 |
| 7,368,031 | B2 * | 5/2008 | Lehr et al. | 156/263 |
| 7,393,255 | B1 * | 7/2008 | Wilhelmi | 441/65 |
| 7,410,399 | B2 * | 8/2008 | Blumenfeld | 441/65 |
| 7,435,150 | B2 * | 10/2008 | Mehiel | 441/74 |
| 7,575,493 | B2 * | 8/2009 | Cheung | 441/74 |
| 7,985,111 | B2 * | 7/2011 | Gasparro | 441/74 |
| 2008/0032575 | A1 * | 2/2008 | Wyrsta et al. | 441/74 |
| 2009/0280704 | A1 * | 11/2009 | Fort | 441/74 |
| 2010/0056003 | A1 * | 3/2010 | Huang | 441/74 |
| 2010/0240271 | A1 * | 9/2010 | Mann | 441/74 |
| 2011/0045720 | A1 * | 2/2011 | Conner, Jr. | 441/74 |
| 2011/0237143 | A1 * | 9/2011 | Chen | 441/68 |
| 2012/0040574 | A1 * | 2/2012 | Grimes et al. | 441/74 |

* cited by examiner

*Primary Examiner* — Lars A Olson
*Assistant Examiner* — Jovon Hayes
(74) *Attorney, Agent, or Firm* — Shaukat A. Karjeker; Colin P. Cahoon; Carstens & Cahoon, LLP

(57) ABSTRACT

A surfboard suitable for wave riding. The surfboard includes a buoyant blank chaving opposed top and bottom blank faces, a pair of rails extending between the opposed top and bottom blank faces at blank face edges. A midline axis extends between a nose region and a tail region and divides the buoyant blank into port and starboard regions, each of which extend between the midline axis and the rail on port and starboard sides. A first reinforcing element associates with at least one of the faces of the buoyant blank wherein the first reinforcing element is disposed substantially within an intermediate part of the port region and extends generally along that region between the nose region and the tail region. A second reinforcing element can also be used.

14 Claims, 3 Drawing Sheets

SURFBOARD

FIELD OF THE INVENTION

The invention relates to an improved surfboard suitable for riding waves.

BACKGROUND OF THE INVENTION

At first glance surfboards look simple but designing a high performing board of predictable performance is a difficult task. This is not only because the board interacts with water flows on the face of a wave close to breaking, making water flow along and around them very complex, but the rider and today's competitions demand high speed, quick turning, and manoeuvres where the board leaves the wave face at one point and rejoins it at another. The board is highly and unpredictably stressed, while it is being directed to perform these manoeuvres. The board is constantly undergoing changing and reversing bending and twist forces while the rider relies on it for his or her safety when riding a wave which is also unpredictable and powerful.

The largest portion of a surfboard by volume is a buoyant block, which, before it is formed into a board, is called a blank and it is usually made of foam. Most often the blank includes a stringer, which is a structural member such as a long beam of balsa or other wood, normally extending along a fore-and-aft midline of the board and glued to both halves of the blank.

To shape the blank, first, a rough outline of a desired board shape is cut from the blank and that outline is machine and hand planed and then sanded. The shaper pays close attention to various characteristics known to affect turning, stability, reliability and speed, including rocker (built-in upward bend) of various sections of the blank, rail or edge sharpness at various points along the blank, tail volume and shape, and rail plan radius along the blank. The shaped blank is then coated with various layers, finishing with a glass fabric layer covered with resin for structural support.

However, because of the large, constantly varying and reversing bending and twisting stresses in the board, known board structures have limitations. Boards can flex unduly and may often break and in other aspects do not provide the performance demanded by skilled riders and spectators.

The present invention provides a new surfboard with useful performance characteristics.

Any reference to or discussion of any document, act or item of knowledge in this specification is included solely for the purpose of providing a context for the present invention. It is not suggested or represented that any of these matters or any combination thereof formed at the priority date part of the common general knowledge, or was known to be relevant to an attempt to solve any problem with which this specification is concerned.

SUMMARY OF THE INVENTION

In a general aspect, the present invention provides a reinforced surfboard having minimal lateral twist in a main central body portion but having tail region flex for improved performance in use.

In accordance with a first aspect of the present invention there is provided a surfboard suitable for wave riding, the surfboard comprising:

- a buoyant blank comprising opposed top and bottom blank faces,
- a pair of rails extending between the opposed top and bottom blank faces at blank face edges, the buoyant blank further comprising a midline axis which extends between a nose region and a tail region and which divides the buoyant blank into port and starboard regions, each of which extend between the midline axis and the rail on port and starboard sides respectively thereof;
- a first reinforcing element associated with at least one of the faces of the buoyant blank wherein the first reinforcing element is disposed substantially within an intermediate part of the port region and extending generally along that region between the nose region and the tail region; and
- a second reinforcing element associated with at least one of the faces of the buoyant blank wherein the second reinforcing element is disposed substantially within an intermediate part of the starboard region and extending generally along that region between the nose region and the tail region.

The reinforcing elements may be any suitable strengthening means such as for example Kevlar tape, glass fibre tape, nomex tape. Preferably, however, the first and second reinforcing elements are lengths of carbon fibre tape. In preferred embodiments the carbon fibre tape is of about 90 mm width, though it could be 30 mm, 40 mm, 45 mm, 50 mm, 75 mm, 80 mm, 100 mm, 110 mm, 125 mm, 150 mm.

The carbon fibre tape may be in great part associated with the top face of the buoyant blank. However, in preferred embodiments the majority of the length of the associated carbon fibre tape is preferably associated with the bottom face of the buoyant blank.

In a preferred form, the reinforcing element is mounted in a mounting recess set into the upper or lower face of the blank, such that the upper surface of the reinforcing element is substantially flush with the face of the blank.

The first reinforcing element is preferably disposed in the port region of the blank in such a way that it increases bending resistance of the blank along the midline axis and also reduces twist in the blank about that same midline axis. The second reinforcing element is adapted to strengthen the blank in the same way, except that it is disposed in the starboard region.

Preferably the reinforcing elements are disposed on the bottom face of their respective port or starboard regions such that they extend between an anterior portion of the tail region adjacent the rail, to a midline area of the nose region. The arrangement is therefore such that the reinforcing elements taper towards one another as they extend toward the nose region. In this manner the greatest twist resistance is in the anterior tail region generally about the middle of the board, where the rider's front foot applies control forces to twist the board.

In preferred embodiments the first and second reinforcing elements extend to a posterior region of the tail, extending around and over the rail on to the upper deck portion so that the deck adjacent the rail of the tail region is covered by the first and second reinforcing elements. The advantage of this arrangement is that the rail of the tail is strengthened in bending, since that is where the rider's rear foot is placed while in use, while flexing of the tail is not generally resisted.

Preferably the buoyant blank is foam and may be polyurethane or expanded polystyrene (EPS).

Preferably there is provided what may be considered to be known elements of surfboard construction to finish the surfboard. That is, once the reinforcing elements are laid on the buoyant blank, the surfboard may be finished with fibreglass mat and resin.

One advantage of a surfboard according to the present invention is the blank does not require a stringer. It will be appreciated, however, that blanks with stringers can be used for the present invention.

Third and fourth reinforcing elements may be provided. These elements are preferably disposed on an opposed blank surface to that of the first and second reinforcing elements. Therefore, when the first and second reinforcing elements are disposed in the bottom face of the blank, the third and fourth reinforcing elements are disposed in the upper face, or deck.

The third and fourth reinforcing elements may be any suitable material such as carbon tape or other materials above described, however, preferably they are carbon fibre rovings or rods, preferably hollow. The rovings are preferably disposed on the deck in a similar manner to the first and second reinforcing elements in that they taper from adjacent the rail of the anterior tail region to the nose region, each one in their respective port or starboard regions. The advantage of the third and fourth reinforcing elements is that they provide additional twist and bending resistance for the middle of the blank, while allowing the tail region to flex.

The advantages of the preferred embodiments of the present invention include that the board has a lively feel, a nice spring back feeling, a reduction in twist in the middle of the blank where control forces are highest, while the tail is free to flex. The board feels like it contains a good amount of pop and twang.

BRIEF DESCRIPTION OF THE DRAWINGS

The invention will now be further explained and illustrated by reference to the accompanying drawings in which.

DETAILED DESCRIPTION OF A PREFERRED EMBODIMENT

Figures 1, 2:
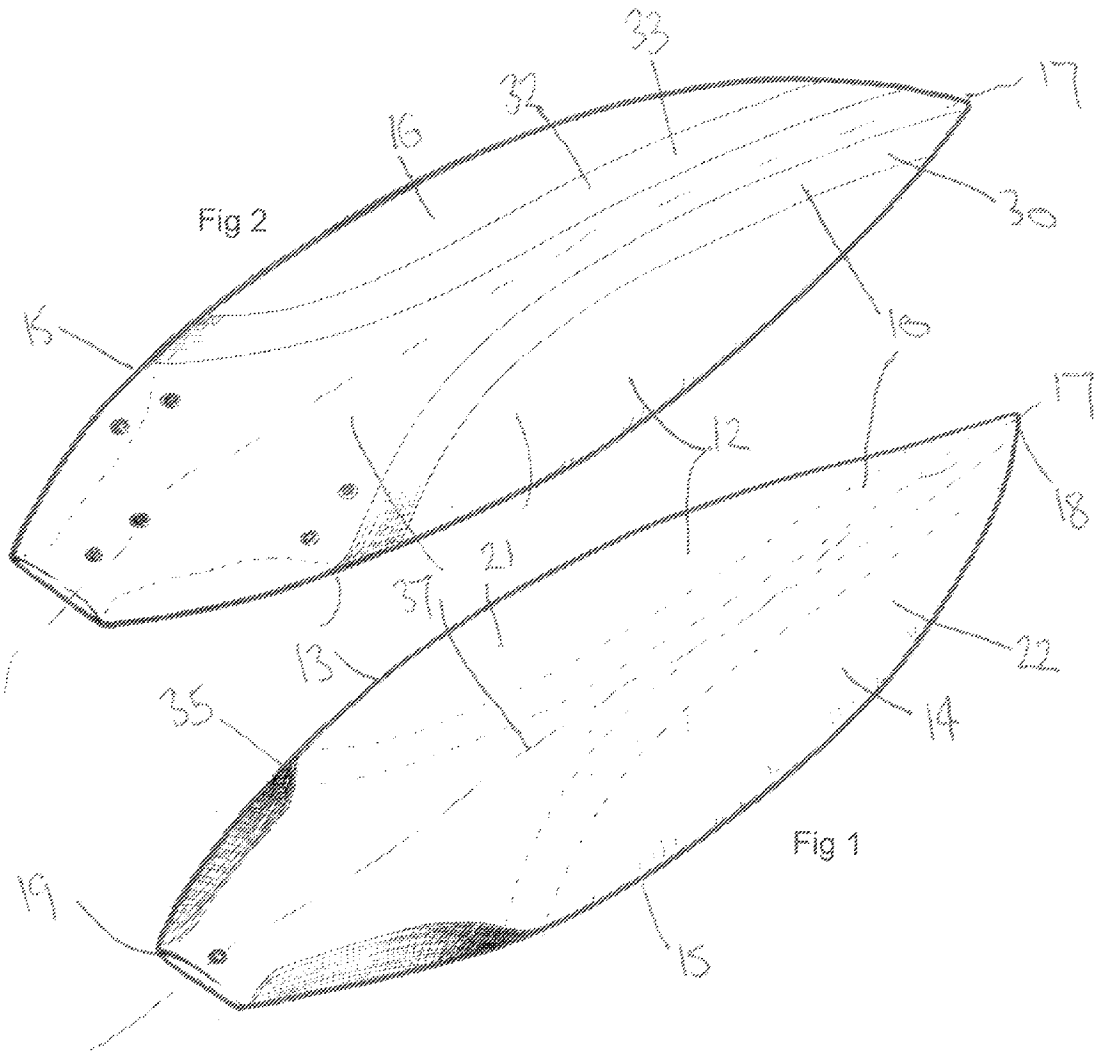
FIG. 1 is a perspective view of the top face or deck of a surfboard according to one preferred embodiment of the invention.
FIG. 2 is a perspective view of the bottom face of the surfboard shown in FIG. 1.
Figure 3:
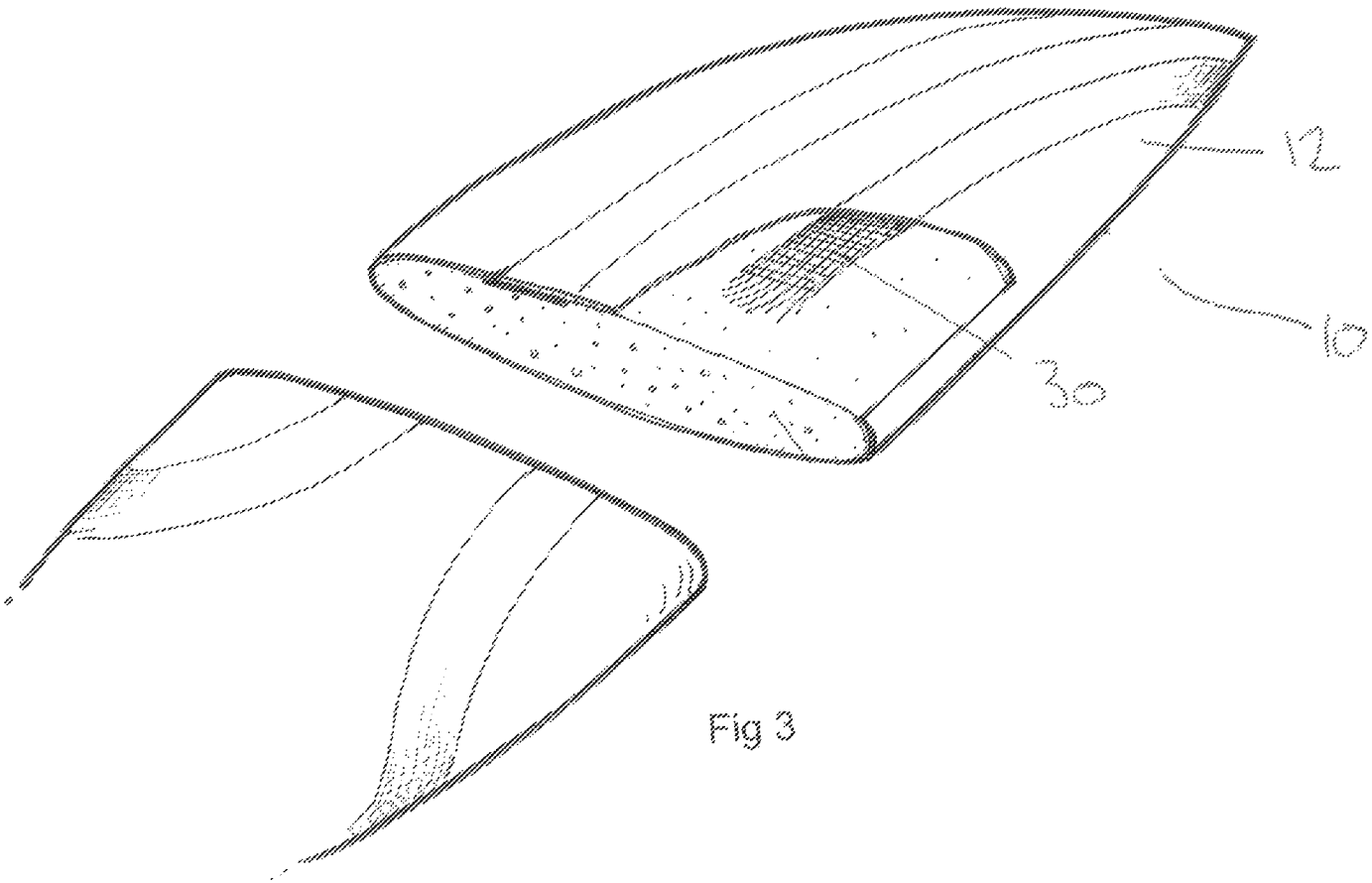
FIG. 3 is a perspective cutaway view of the bottom face of the surfboard of FIG. 1 showing elements of the structure of the board.

Referring to the drawings there is shown a surfboard suitable for wave riding, the surfboard generally indicated at 10 and comprising a buoyant blank 12 which itself comprises a top blank face or deck 14 and a bottom blank face 16 opposed to the top blank face, as well as a pair of rails, being a port rail 13 and a starboard rail 15 extending between the top and bottom blank faces at blank face edges.

The buoyant blank 12 further comprises a midline axis 17 which extends between a nose region 18 and a tail region 19 and which divides the buoyant blank into a port region 21 and a starboard region 22, each region extending between the midline axis 17 and the port rail 13 on the port side, and the starboard rail 15 on the starboard side.

A first reinforcing element 30 is provided and is associated with the bottom face 16 of the buoyant blank 12. That first reinforcing element 30 is disposed substantially within an intermediate part of the port region 21 and extends generally along that region 21 between the nose region 18 and the tail region 19. A second reinforcing element 32 is provided and is associated with the bottom face 16 of the buoyant blank wherein the second reinforcing element 32 is disposed substantially within an intermediate part of the starboard region 22 and extends generally along that region between the nose region 18 and the tail region 19.

The first and second reinforcing elements 30, 32 are in the form of lengths of carbon fibre tape 33. The carbon fibre tape 33 is of about 90 mm width, though it could be 30 mm, 40 mm, 45 mm, 50 mm, 75 mm, 80 mm, 100 mm, 110 mm, 125 mm, or 150 mm.

The majority of the length of the carbon fibre tape 33 is associated with the bottom face 16 of the blank 12. The first reinforcing element 30 is disposed in the port region 21 of the blank 12 in such a way that it increases bending resistance of the blank along the midline axis 17 and also reduces twist in the blank about that same midline axis 17. The second reinforcing element 32 is adapted to strengthen the blank 12 in the same way, except that it is disposed in the starboard region 22.

The reinforcing elements 30, 32 are disposed on the bottom face 16 of their respective port 21 or starboard regions 22 such that they extend between an anterior portion 35 of the tail region 19 adjacent their respective rail 13, 15 to a midline area of the nose region 18. The arrangement is therefore such that the reinforcing elements 30, 32 taper towards one another as they extend toward the nose region 18. In this manner the greatest twist resistance is in the anterior tail region 35 generally about the middle of the board 37, where the rider's front foot applies control forces to twist the board 10.

In preferred embodiments the first and second reinforcing elements extend to a posterior region of the tail, extending around and over the rail on to the upper deck portion so that the deck adjacent the rail of the tail region is covered by the first and second reinforcing elements. The advantage of this arrangement is that the rail of the tail is strengthened in bending, since that is where the rider's foot stands while in use, while twisting of the tail is not generally resisted.

In order to associate the reinforcing elements 30, 32 with the bottom face 16 of the blank 12, the reinforcing elements 30, 32 are mounted in a mounting recess (not shown) set into the upper 14 or lower 16 face of the blank 12, such that the upper surface of the reinforcing element is flush with the face of the blank 12.

Figure 4:
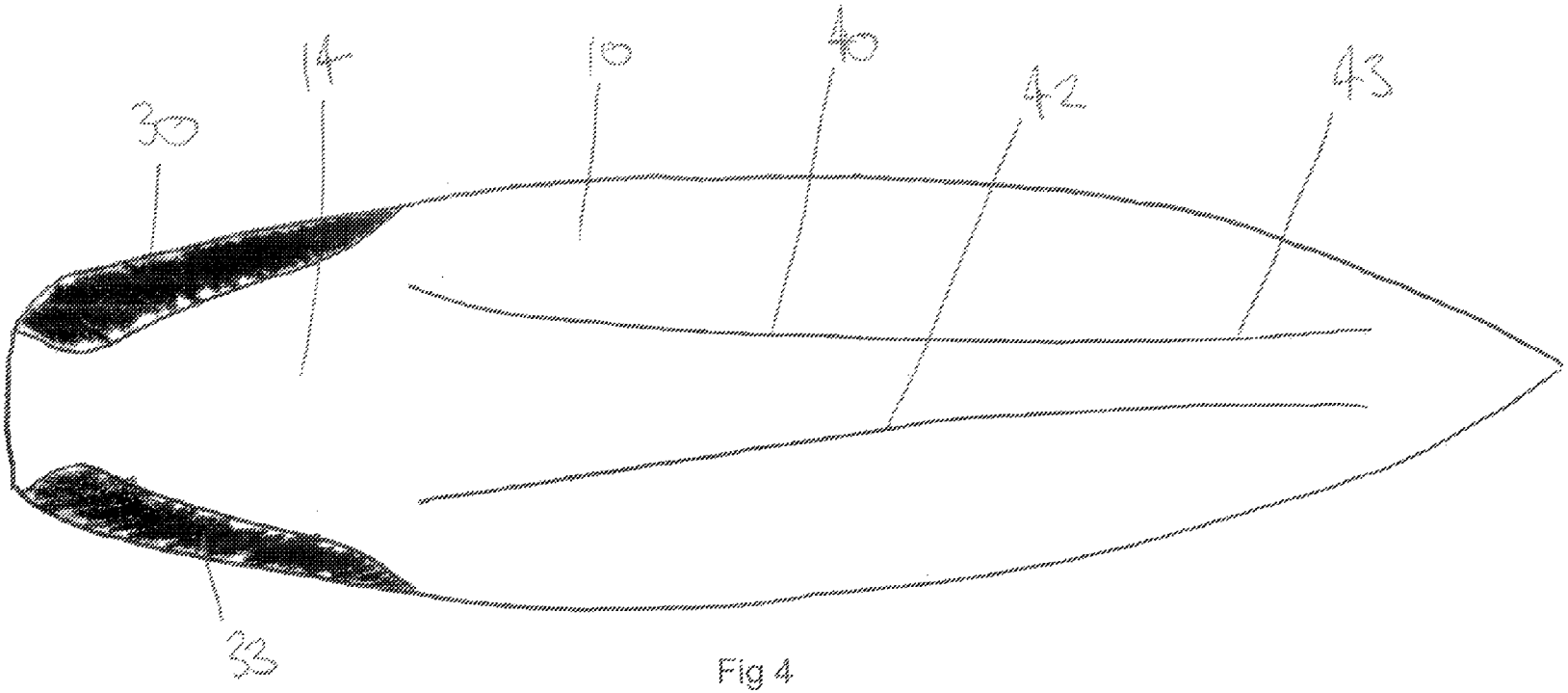
FIG. 4 is a plan view of a surfboard in accordance with another embodiment of the present invention.

Third and fourth reinforcing elements 40, 42 are provided in some embodiments, in particular that shown in FIG. 4. These elements 40, 42 are disposed on an opposed blank surface to that of the first and second reinforcing elements. Therefore, when the first and second reinforcing elements 30, 32 are disposed in the bottom face 16 of the blank 12, the third and fourth reinforcing elements 40, 42 are disposed in the upper face or deck 14.

The third and fourth reinforcing elements 40, 42 are formed from carbon fibre hollow rovings or rods 43. The rovings 43 are disposed on the deck 14 in a similar manner to the first and second reinforcing elements 30, 32 in that they taper from adjacent the rail of the anterior of the tail region 18 to the nose region 18, each one in their respective port or starboard regions. The advantage of the third and fourth reinforcing elements 40, 42 is that they provide additional twist and bending resistance for the middle of the blank, while allowing the tail region to flex.

Once the reinforcing elements are laid on the buoyant blank, the board is finished with fibreglass mat and resin.

The advantages of the preferred embodiments of the present invention include that the board has a lively feel, a nice spring back feeling, a reduction in twist in the middle of the blank where control forces are highest, while the tail is free to flex. The board feels like it contains a good amount of pop and twang.

It is to be noted that, throughout the description and claims of this specification, the word 'comprise' and variations of the word, such as 'comprising' and 'comprises', is not intended to exclude other variants or additional components, integers or steps. Modifications and improvements to the invention will be readily apparent to those skilled in the art. Such modifications and improvements are intended to be within the scope of this invention.

I claim:

1. A surfboard suitable for riding a wave, the surfboard comprising: a buoyant blank comprising opposed top and bottom blank faces, a pair of opposed rails extending between the opposed top and bottom blank faces at blank face edges, the buoyant blank further comprising a midline axis which extends between a nose region and a tail region and which divides the buoyant blank into port and starboard regions, each of which extend between the midline axis and the rail on port and starboard sides respectively thereof; a first reinforcing tape element associated with at least one of the faces of the buoyant blank wherein the first reinforcing element is disposed within the port region and extending along the port region on a curved path between the nose region and the tail region; and a second reinforcing tape element associated with at least one of the faces of the buoyant blank wherein the second reinforcing element is disposed within the starboard region and extending along the starboard region on a curved path between the nose region and the tail region; wherein the first and second reinforcing elements comprise discrete lengths of reinforcing tape separately disposed on the same blank face such that the first and second reinforcing elements are spaced apart from each other with the midline axis between them.

2. The surfboard in accordance with claim 1 wherein the reinforcing tape elements comprise carbon fiber tape.

3. The surfboard in accordance with claim 1 wherein the reinforcing tape elements are disposed along the bottom face of the blank.

4. The surfboard in accordance with claim 1 wherein the reinforcing tape elements are each mounted in a mounting recesses set into the upper or lower face of the blank, such that an upper surface of each reinforcing tape element is flush with the face of the blank.

5. The surfboard in accordance with claim 1 wherein the first reinforcing tape element is disposed in the port region of the blank in such a way that it increases bending resistance of the blank along the midline axis and also reduces twist in the blank about the midline axis.

6. The surfboard in accordance with claim 1 wherein the reinforcing tape elements are disposed on the bottom face of their respective port or starboard regions such that they extend between an anterior portion of the tail region adjacent the rail, to a midline area of the nose region, in that they taper towards one another as they extend toward the nose region.

7. The surfboard in accordance with claim 1 wherein the first and second reinforcing tape elements extend to a posterior region of the tail, extending around and over the rail on to the upper deck portion so that the deck adjacent the rail of the tail region is covered by the first and second reinforcing tape elements.

8. The surfboard in accordance with claim 1 further comprising third and fourth reinforcing tape elements disposed on an opposed blank surface to the first and second reinforcing tape elements.

9. The surfboard in accordance with claim 8 wherein the third and fourth reinforcing tape elements comprise hollow carbon fiber rovings or rods.

10. The surfboard in accordance with claim 9 wherein the rovings are disposed on the deck, tapering from adjacent the rail of the anterior tail region to the nose region, each one in their respective port or starboard regions.

11. The surfboard in accordance with claim 1 wherein the buoyant blank is stringerless.

12. The surfboard in accordance with claim 1 wherein the first reinforcing tape element and the second reinforcing tape element extend from an anterior portion of the tail region adjacent opposed rails and curve toward the midline axis at the nose region.

13. A surfboard in accordance with claim 1 wherein the first reinforcing tape element and the second reinforcing tape element are spaced apart from one another, on their respective associated faces of the buoyant blank, by a selected distance over their entire length.

14. A surfboard in accordance with claim 13 wherein the first reinforcing tape element and the second reinforcing tape element extend from an anterior portion of the tail region adjacent opposed rails and curve toward the midline axis at the nose region.

* * * * *